US007537125B2

(12) United States Patent
Plouchart

(10) Patent No.: US 7,537,125 B2
(45) Date of Patent: May 26, 2009

(54) ROTARY SUPPLY ORGANIZER FOR ART, CRAFT AND SUNDRY TOOLS

(76) Inventor: Philip John Plouchart, 268 N. 9th St., San Jose, CA (US) 95112-3453

( * ) Notice: Subject to any disclaimer, the term of this patent is extended or adjusted under 35 U.S.C. 154(b) by 156 days.

(21) Appl. No.: 11/361,567

(22) Filed: Feb. 25, 2006

(65) Prior Publication Data

US 2007/0199909 A1 Aug. 30, 2007

(51) Int. Cl.
*A47F 7/00* (2006.01)

(52) U.S. Cl. ..... 211/70.6; 211/198

(58) Field of Classification Search ..... 211/70.6, 211/189, 59.1, 134, 198, 113, 57.1, 200, 211/70, 78, 163; 248/453, 441.1, 220.31
See application file for complete search history.

(56) References Cited

U.S. PATENT DOCUMENTS 2,002,128 A * 5/1935 Reidenbaugh ..... 211/1
2,865,132 A * 12/1958 Fleming ..... 281/51
2,981,030 A * 4/1961 Knop ..... 211/74
3,224,113 A * 12/1965 Goldsholl ..... 434/98
3,263,347 A * 8/1966 McCutcheon ..... 434/430
3,863,575 A * 2/1975 Kuns et al. ..... 108/179
4,666,038 A * 5/1987 Minneman ..... 206/315.2
5,273,248 A * 12/1993 Grander ..... 248/460
5,284,256 A * 2/1994 Correll-Antoun ..... 211/42
5,393,030 A * 2/1995 Tarozzi ..... 248/460
5,542,640 A * 8/1996 Tarozzi ..... 248/460
D375,002 S * 10/1996 Sosso ..... D6/449
5,713,552 A * 2/1998 Diamant ..... 248/460
6,478,281 B1 * 11/2002 Turner ..... 248/441.1
6,805,246 B1 * 10/2004 Manabat ..... 211/13.1
6,955,130 B2 * 10/2005 Phillips ..... 108/96
7,150,362 B1 * 12/2006 Questiaux et al. ..... 211/70.6
7,237,757 B2 * 7/2007 Wakura ..... 248/454
7,258,230 B2 * 8/2007 Hernandez et al. ..... 206/373
2005/0224380 A1 * 10/2005 Hernandez et al. ..... 206/373

* cited by examiner

*Primary Examiner*—Jennifer E. Novosad
(74) *Attorney, Agent, or Firm*—Adams Law Office; Sharon J. Adams

(57) ABSTRACT

A two-sided, rotary organizer to allow quick access to an artist's or craft person's paints, tools and supplies, while providing storage in a minimum space. The device is supplied with two vertical angled surfaces and six shelves so all items are separate and organized vertically. The user can customize and increase storage by repositioning and adding shelves. The vertical angled surfaces comprise a plurality of apertures and associated tabs that can be bent to receive supplies. The space on the platform, between the two angled surfaces, permits storage of other items, i.e. related liquids, brushes, rags, etc.

11 Claims, 4 Drawing Sheets

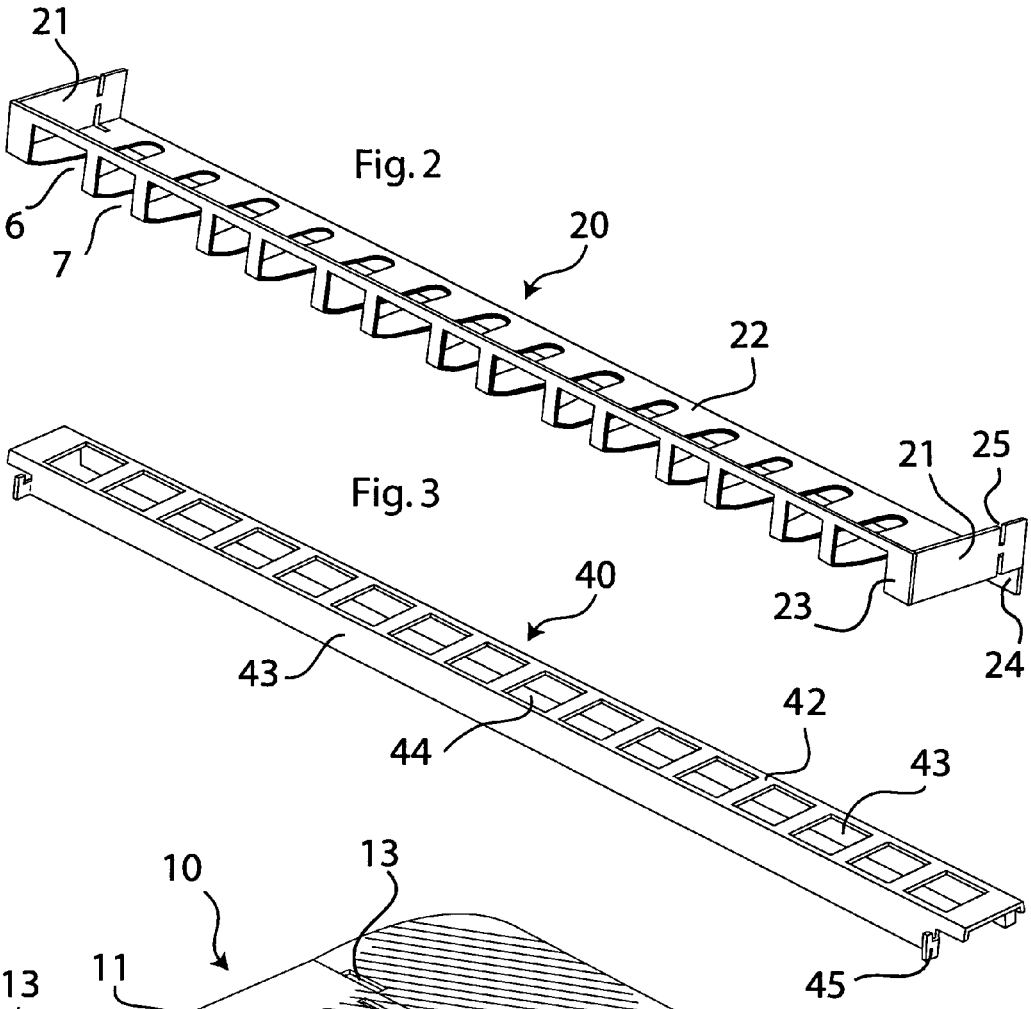
Fig. 2
Fig. 3
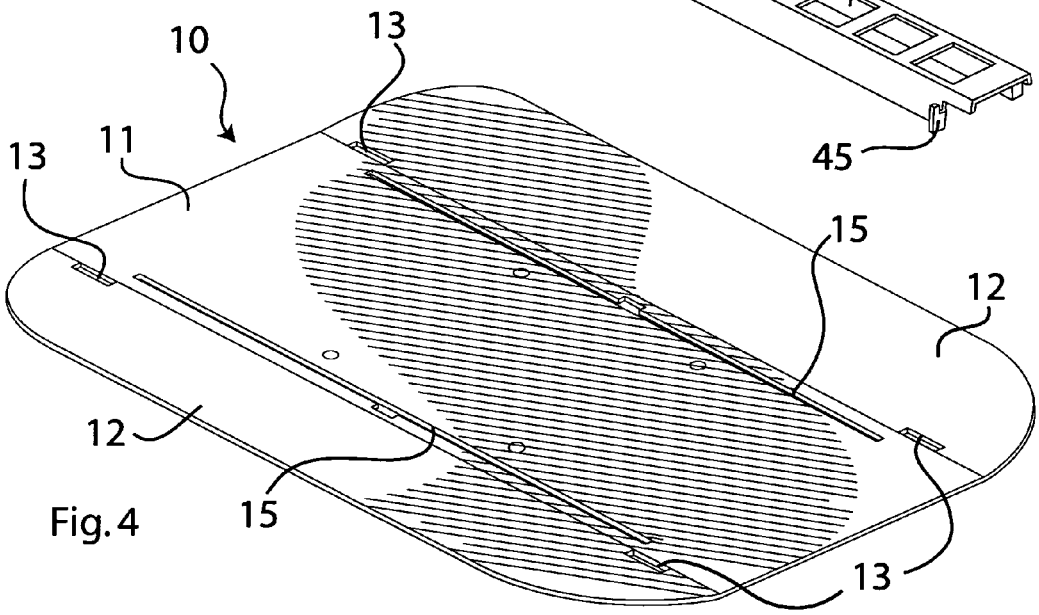
Fig. 4

ROTARY SUPPLY ORGANIZER FOR ART, CRAFT AND SUNDRY TOOLS

BACKGROUND OF INVENTION

The present invention is a rotary organizer designed to store artist paint tubes, bottles, jars, brushes, craft supplies, and sundry tools in a vertical format. No such single device has been nor is presently available commercially. All present commercial organizers offered to artists or craft persons are limited in their utility, whether in the studio, classroom, work space, or when traveling. Typically, an artist or craft person stores the above named items in a shoe box, in a commercially-built case, in a backpack, or in a portable gear/tackle bin. In the process of painting or craft work, these storage styles waste space, access time and effort.

A briefcase storage style located near the artist or craft person at work usually lies horizontally, so that the organized paint tubes, bottles, jars, brushes and craft supplies are reached with a certain effort, which increases with the number of items. If not organized, the jumbled contents require time and effort to be separated and selected, when searching for a specific color or a single item.

In the portable art bin case, the built-in extending drawers are too few and inadequately shaped for complete, appropriate organized storage and are positioned awkwardly in reaching for a specific item, when the reach is horizontal. Because the drawers remain horizontal when extended up and outwardly, the drawers' contents face the ceiling in lieu of facing the user. In the bin's bottom space, below the folding drawers, the contents become jumbled in a narrow or shallow space. Consequently, the tubes get dinged, leak and are stained with paint, as would also occur in a shoe box, in a backpack, in briefcase storages, and so are not immediately recognizable nor accessible.

BRIEF SUMMARY OF THE INVENTION

A rotary organizer which stores artist paint tubes, bottles, jars, brushes, craft supplies and sundry tools in a vertical format. This invention saves time, space and effort when the user searches for a specific item among a plural selection of such items, within a minimum surface footprint. Using this product obviates the typical wasteful situations where: A/tubes, bottles, jars, brushes, craft supplies and tools are contained loosely in a case or box, or B/are organized fan-like onto a horizontal surface.

This organizer presents two vertical surfaces secured onto a level platform, which is hand-turned by means of a rotary mechanism on a base. The organizer includes detachable shelves, which are secured onto the vertical surfaces at varying locations. Each shelf contains a plurality of consecutive, multi-standard slots. Each slot accepts a tube of artist paint, hanging by its cap or its neck. Each shelf permits the storage of 2 oz. paint bottles, corresponding ink bottles and jars and upside-down wide-capped tubes, when regular tubes are not hanging from it.

The vertical surfaces include a pattern of apertures with tabs that can be bent up to allow the vertical storage of perforated items. The vertical surfaces are secured at the top by means of a snapping connector bracket. The vertical surfaces are secured at the bottom by means of tabs, which pivot and lock into the platform through corresponding apertures. The platform's level area incorporates two parallel channels, which permit and contain the operation of a bi-directional sliding tray.

BRIEF DESCRIPTION OF THE DRAWINGS

FIG. 2 illustrates a perspective view of a shelf unit.

FIG. 3 illustrates a perspective view of a connecting bracket.

FIG. 4 illustrates a perspective view of the platform.

DETAILED DESCRIPTION OF THE DRAWINGS

Figure 1:
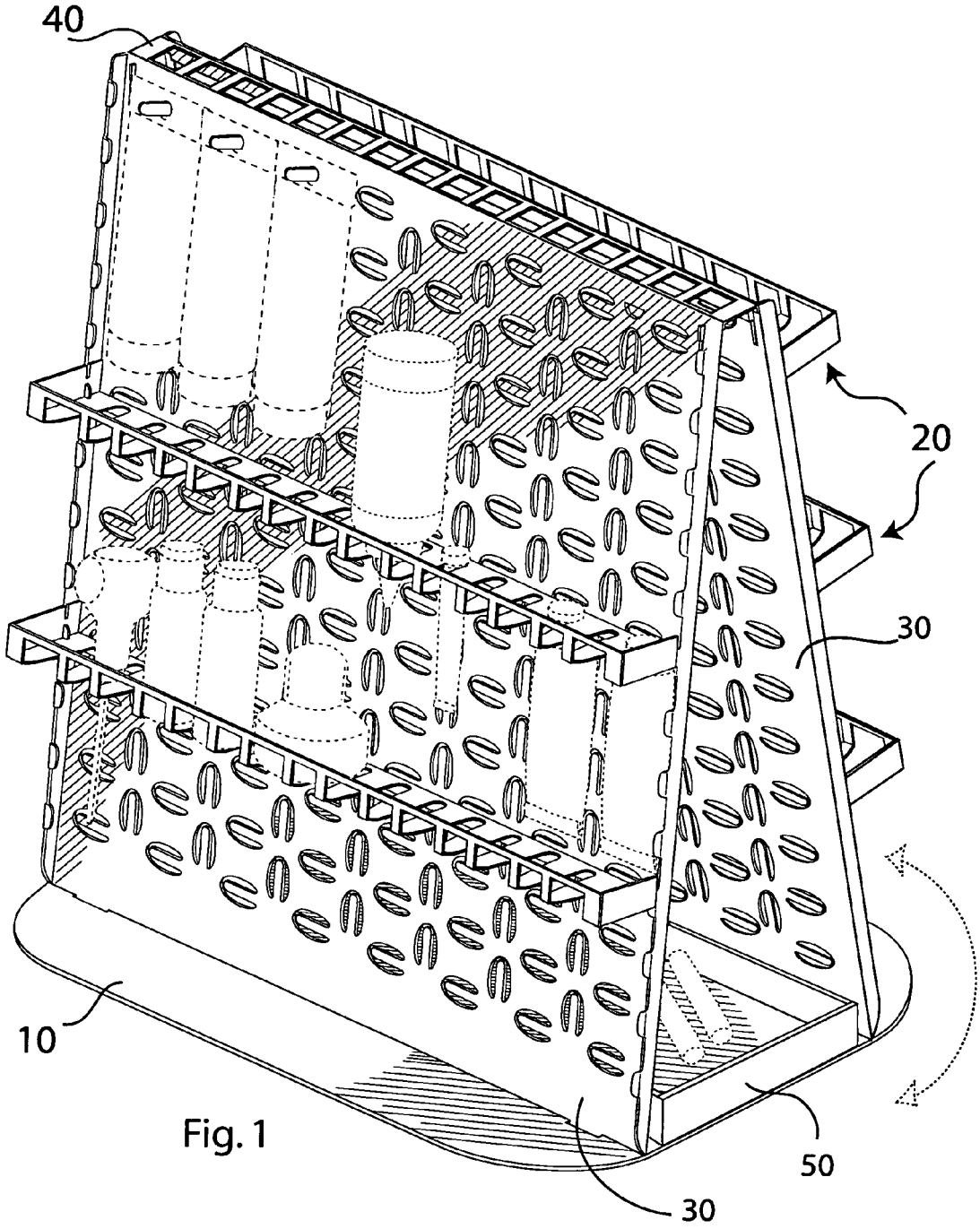
FIG. 1 illustrates a perspective view of the vertical angled surfaces.

FIG. 2 illustrates a three-dimensional perspective view of a bracket shelf unit 20. This unit's length matches the platform's width. It is comprised of one planar level surface 22 and four perpendicular planes, at 90° therefrom. Two vertical planes 21 at each lateral end of the bracket shelf 20 restrain all materials which rest upon the planar surface 22. A third vertical plane 23 comprises the front of the bracket shelf and incorporates two distinct rows of alternating consecutive apertures 6,7. The first row entails eight large apertures 6, designed to receive most artist paint tubes by the cap or neck. The second row entails seven narrower apertures 7, designed to receive the narrowest artist paint tubes, by the cap or the neck. All apertures 6,7 begin on the frontal plane 23 and turn at 90° to end horizontally at the rear of the planar surface 22, near the perpendicular plane 24. A fourth vertical plane 24 turns down squarely at 90° from the planar surface length 22 to form the bracket's back and lower plane 24. The lower plane 24 is parallel to and rests against the angled surface 30. Integral to each lateral plane 21 are channel apertures 25 shaped to slide into a catch 37, to be secured onto the vertical surface 30.

The two vertical surfaces 30 are bridged by an independent connecting bracket 40. Each vertical surface 30 is comprised of a plurality of apertures 33 in a set pattern and is a mirror image of the second side. Each aperture features an oblong tab 34 designed, sized and shaped to be bent away from the vertical surface plane 30, at the ideal of 90°, for the purpose of hanging perforated suspendible supplies or tools. At the base of each vertical surface 30 are two formed tabs 31 which are the pivoting points to secure each vertical surface 30 into the platform 10. At the upper level of each vertical surface 30 are extruded flanges 35 which are designed to receive and secure the connecting bracket 40 from the back side. Also at this upper level are apertures 36 positioned to catch and secure the connecting bracket corner flanges 45 to the vertical surface 30. Also, the vertical surface 30 functions as an independent modular unit, which can be secured to any vertical surface without a platform.

FIG. 3. Illustrates a perspective view of the connector bracket 40. The connector bracket is an inverted U-shaped bridge which secures the two vertical surfaces 30. It is comprised of one horizontal 42 and two vertical planes 43. The horizontal plane 42 contains a series of apertures 44, which are designed in a pattern to receive and store narrow tools, such as brushes. A shaped wing flange 45 at each corner of the bracket is formed at 90 degrees for insertion into the corresponding vertical surface apertures 36.

FIG. 4 illustrates a perspective view of a platform 10. The platform is the horizontal foundation upon which are secured two vertical surfaces 30 and a sliding tray 50. Its four corners are rounded for safety, as the unit is rotated manually. The platform 10 contains a level surface 11 and two angled surfaces 12. The twin angled surfaces 12 are integral parts of the platform 10 from which they are formed, to create the perpendicular angle of 90° relative to the vertical surfaces 30. Integrated in the angled surfaces are four apertures 13 placed to permit the pivoting and securing of the removable vertical surfaces 30. In the level surfaces are two parallel channels 15 which permit the placement and securing of a sliding tray 50. The level surface also creates the base for securing a rotary mechanism 60.

Figure 5:
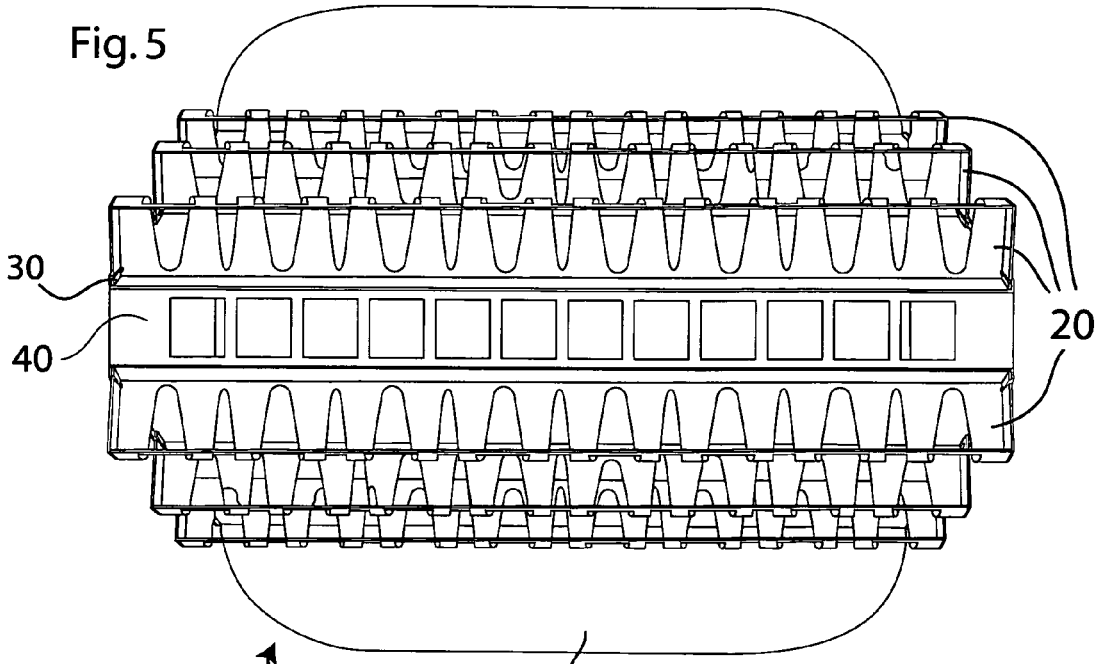
FIG. 5 illustrates a top view of the invention.

FIG. 5 illustrates a top view of the invention. The left side is a mirror view of the right. A connecting bracket 40 bridges and secures both sides at the superior level. The two sides are secured at the lower level into an angled platform 12.

Figure 6:
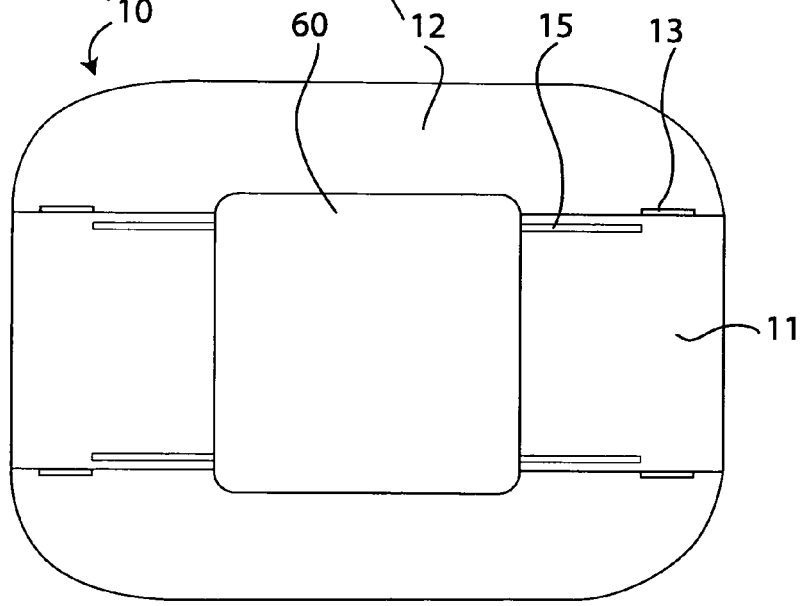
FIG. 6 illustrates a bottom view of the invention.

FIG. 6 illustrates a bottom view of the invention. The rectangular shape at the center constitutes a platform 11 to which is secured a rotary mechanism base 60 that creates balance with rotation. The opposite shelves 12 are integral parts of the platform 10 and are angled up from the pivot apertures 13 to be perpendicular with the vertical surfaces 30. In the level surface 11 are two parallel channels 15 which permit the placement and securing of a sliding tray 50. The platform corners are designed with curves for safety, as the organizer is rotated manually. Integrated in the angled surfaces are four apertures 13 placed to permit the pivoting and securing of the removable vertical surfaces 30. The level surface also creates the base for securing a rotary mechanism.

Figure 7:
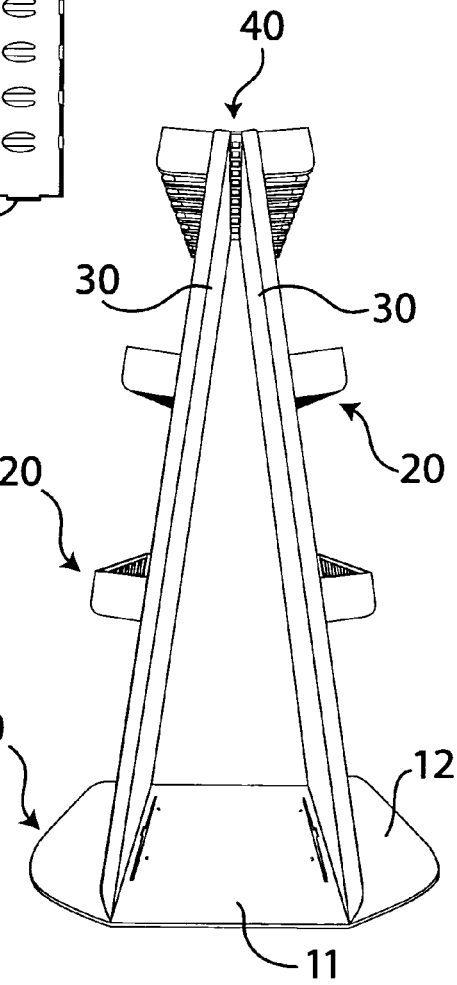
FIG. 7 illustrates a lateral vertical view of the invention.

FIG. 7 illustrates a lateral view of the invention.

The left side is a mirror view of the right side. This view encompasses a lateral profile of six bracket shelves 20 secured onto the two vertical surfaces 30. The vertical surfaces 30 are secured at the superior level by a connecting bracket 40 and at the inferior level to the platform 10. In the level surface 11 are two parallel channels 15 which permit the placement and securing of a sliding tray 50. The twin angled surfaces 12 are integral parts of the platform 10 from which they are formed, to create the perpendicular angle of 90° relative to the vertical surfaces 30. They become shelves which permit the storage of brushes and other narrow tools. The four corners are rounded for safety, as the unit is rotated manually. The level surface 11 also creates the base for securing the rotary mechanism 60 to its underside.

Figure 8:
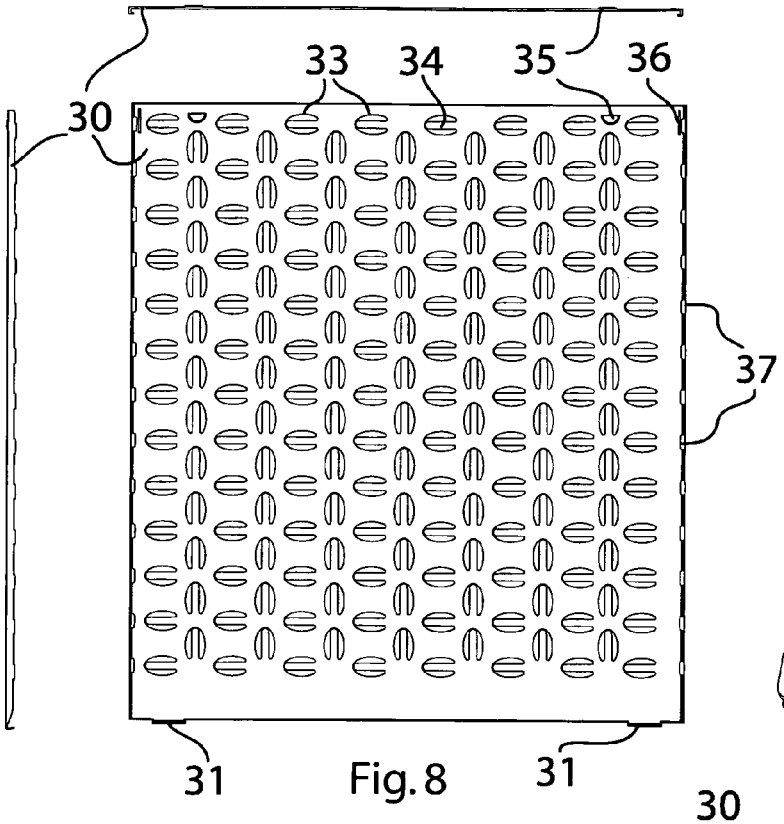
FIG. 8 illustrates a frontal, a lateral and a top view of the surface.

FIG. 8 illustrates a frontal, lateral and a top view of vertical surface 30. The vertical surface 30 is a panel which receives and secures shelves 20 by means of channel apertures 25, positioned at the two opposite planes 21 into formed catches 37, which are integrated into the vertical surface's 30 lateral edges. The vertical surface 30 is comprised of a plurality of apertures 33 arranged in a set pattern. Each aperture features an oblong tab 34 designed, sized and shaped to be bent away from the vertical surface plane 30, at the ideal of 90°, for the purpose of hanging perforated suspendible supplies or tools.

At the base of the vertical surface 30 are formed tabs 31 which are the pivoting points for securing the vertical surface 30 into the platform 10. At the superior level of the vertical surface 30 are hemispherical embossed flanges 35 which are designed to receive and secure the connecting bracket 40 with a slide and snap action, from the back side along its base edges. Also at this superior level are apertures 36 positioned to catch and secure the connecting bracket corner flanges 45 into the vertical surface 30.

The invention claimed is:

1. A rotary organizer comprising:

a platform comprising a level surface, two angled surfaces, a top side, and a bottom side wherein said bottom side is connected with a rotary mechanism and wherein said top side of each angled surface is perpendicularly connected with a substantially vertical surface;

wherein each of said substantially vertical surfaces comprises an inferior level perpendicularly connected with one of said angled surface of said platform, a superior level connected with a connecting bracket, and a plurality of apertures wherein each aperture has a bendable oblong tab capable of receiving supplies;

said connecting bracket comprising two vertical planes connected by a horizontal plane, said horizontal plane having a plurality of apertures capable of receiving supplies, and wherein each vertical plane connects with said superior level of one of said substantially vertical surfaces, thereby connecting and bridging two substantially vertical surfaces;

a plurality of bracket shelves wherein each of said bracket shelves comprises a frontal vertical plane connected with a planar level surface that is connected with a lower plane, wherein said frontal plane has alternating narrower and wider apertures to receive supplies, and wherein each bracket shelf is removeably connected with one substantially vertical surface.

2. The rotary organizer of claim 1 wherein said inferior level of each substantially vertical surface additionally comprises at least one tab that is capable of being received by a tab receiving aperture in said platform, wherein said tab connects said vertical surface with said platform.

3. The rotary organizer of claim 1 wherein said plurality of apertures in a first substantially vertical surface is a mirror image of said plurality of apertures in a second substantially vertical surface.

4. The rotary organizer of claim 1 wherein said connecting bracket additionally comprises a plurality of shaped wing flanges wherein each of said shaped wing flanges is capable of being received by a corresponding aperture in one of said substantially vertical surfaces, wherein said shaped wing flanges connect said connecting bracket with said substantially vertical surfaces.

5. The rotary organizer of claim 1 wherein said superior level of each substantially vertical surface additionally comprises at least one embossed flange to receive said connecting bracket, wherein said embossed flange connects said connecting bracket with said substantially vertical surface.

6. The rotary organizer of claim 1 wherein said platform has rounded corners.

7. The rotary organizer of claim 1 wherein a sliding tray is placed on said platform.

8. The rotary organizer of claim 7 wherein said sliding tray is secured to said platform by two parallel channels in said platform.

9. The rotary organizer of claim 1 wherein each bracket shelf additionally comprises a lateral vertical plane at each end of said planar level surface, and wherein each lateral plane comprises at least one channel aperture capable of being received by a corresponding catch on said substantially vertical surface, wherein said channel aperture and said catch removeably connects said bracket shelf with said substantially vertical surface.

10. The rotary organizer of claim 9 wherein said substantially vertical surface has a plurality of catches.

11. The rotary organizer of claim 2 wherein each tab pivots and locks to said receiving aperture.

* * * * *